US007597077B1

(12) United States Patent
Arnold et al.

(10) Patent No.: US 7,597,077 B1
(45) Date of Patent: Oct. 6, 2009

(54) V-TYPE ENGINE

(75) Inventors: David W. Arnold, Glendale, CA (US); Michael Bury, Temecula, CA (US)

(73) Assignee: Honda Motor Company, Ltd., Tokyo (JP)

( * ) Notice: Subject to any disclaimer, the term of this patent is extended or adjusted under 35 U.S.C. 154(b) by 0 days.

(21) Appl. No.: 12/178,810

(22) Filed: Jul. 24, 2008

(51) Int. Cl.
*F01L 1/02* (2006.01)

(52) U.S. Cl. ..... 123/90.31; 123/192.2

(58) Field of Classification Search ..... 123/54.1–54.8, 123/90.27, 90.31, 192.2; 74/603, 604
See application file for complete search history.

(56) References Cited

U.S. PATENT DOCUMENTS

| | | | | |
|---|---|---|---|---|
| 2,280,384 | A * | 4/1942 | Diekson | 74/604 |
| 4,395,980 | A | 8/1983 | Tominaga et al. | |
| 4,633,826 | A | 1/1987 | Tominaga et al. | |
| 4,741,303 | A | 5/1988 | Kronich | |
| 5,065,644 | A | 11/1991 | Shimada | |
| 5,174,257 | A | 12/1992 | Ozawa | |
| 5,375,571 | A | 12/1994 | Diehl et al. | |
| 5,564,380 | A | 10/1996 | Kobayashi et al. | |
| 6,244,237 | B1 | 6/2001 | Sayama et al. | |
| 6,257,178 | B1 | 7/2001 | Laimbock | |
| 6,374,789 | B2 | 4/2002 | Kawamoto | |
| 6,718,934 | B2 | 4/2004 | Ohsawa | |
| 2002/0038644 | A1 | 4/2002 | Korenjak | |

* cited by examiner

*Primary Examiner*—Noah Kamen
(74) *Attorney, Agent, or Firm*—Ulmer & Berne LLP

(57) ABSTRACT

A V-type engine includes a housing, a crankshaft, a counterbalance shaft, a first camshaft, and a second camshaft. The crankshaft, the counterbalance shaft, the first camshaft, and the second camshaft are rotatably supported by the housing. The crankshaft has a crankpin. In one embodiment, an imaginary plane perpendicular to the rotational axis of the crankshaft intersects each of the crankpin and the counterbalance shaft such that the crankshaft is operatively coupled with each of the counterbalance shaft and the first camshaft on one side of the imaginary plane, and the counterbalance shaft is operatively coupled with the second camshaft on an opposite side of the imaginary plane. The V-type engine may be included in a vehicle.

21 Claims, 6 Drawing Sheets

V-TYPE ENGINE

TECHNICAL FIELD

A V-type engine includes a crankshaft, a counterbalance shaft, and at least two camshafts.

BACKGROUND

Conventional V-type engines can be provided in any of a variety of configurations. For example, a V-type engine can be provided as a V-twin engine with a total of two pistons. Alternatively, some conventional V-type engines have four pistons, six pistons, eight pistons, ten pistons, or twelve pistons. In such conventional configurations, it is common for the engine to include at least two separate camshafts. In one particular configuration, one camshaft is provided to operate the intake and exhaust valves for the piston(s) on one side of the "V", while a separate camshaft is used to control the intake and exhaust valves for the piston(s) on the other side of the "V". In a conventional V-twin engine, the first of these camshafts is operably coupled with the engine's crankshaft on one side of the engine, while the other of these camshafts is operably coupled with the engine's crankshaft on the other side of the engine.

SUMMARY

In accordance with one embodiment, a V-type engine comprises a housing, a crankshaft, a first piston, a second piston, a counterbalance shaft, a first camshaft, and a second camshaft. The crankshaft is rotatably supported by the housing and has a crankpin. The first and second pistons are operatively connected to the crankpin. The counterbalance shaft is rotatably supported by the housing. The first camshaft is rotatably supported by the housing and is associated with the first piston. The second camshaft is rotatably supported by the housing and is associated with the second piston. An imaginary plane is perpendicular to the rotational axis of the crankshaft and intersects each of the crankpin and the counterbalance shaft. The crankshaft is operatively coupled with each of the counterbalance shaft and the first camshaft on one side of the imaginary plane. The counterbalance shaft is operatively coupled with the second camshaft on an opposite side of the imaginary plane.

In accordance with another embodiment, a V-type engine comprises a housing, a crankshaft, a counterbalance shaft, a first camshaft, and a second camshaft. The crankshaft comprises a crankpin and a first drive element and is rotatably supported by the housing. The counterbalance shaft comprises a second drive element and a third drive element and is rotatably supported by the housing such that the second drive element is operatively coupled with the first drive element. The first camshaft comprises a fourth drive element and is rotatably supported by the housing such that the fourth drive element is operatively coupled with the first drive element. The second camshaft comprises a fifth drive element and is rotatably supported by the housing such that the fifth drive element is operatively coupled with the third drive element.

In accordance with yet another embodiment, a vehicle has a V-type engine. The V-type engine comprises a housing; a crankshaft, a first piston, a second piston, a counterbalance shaft, a first camshaft, and a second camshaft. The crankshaft is rotatably supported by the housing and has a crankpin. The first and second pistons are operatively connected to the crankpin. The counterbalance shaft is rotatably supported by the housing. The first camshaft is rotatably supported by the housing and is associated with the first piston. The second camshaft is rotatably supported by the housing and is associated with the second piston. An imaginary plane is perpendicular to the rotational axis of the crankshaft and intersects each of the crankpin and the counterbalance shaft. The crankshaft is operatively coupled with each of the counterbalance shaft and the first camshaft on one side of the imaginary plane. The counterbalance shaft is operatively coupled with the second camshaft on an opposite side of the imaginary plane.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

Figure 1:
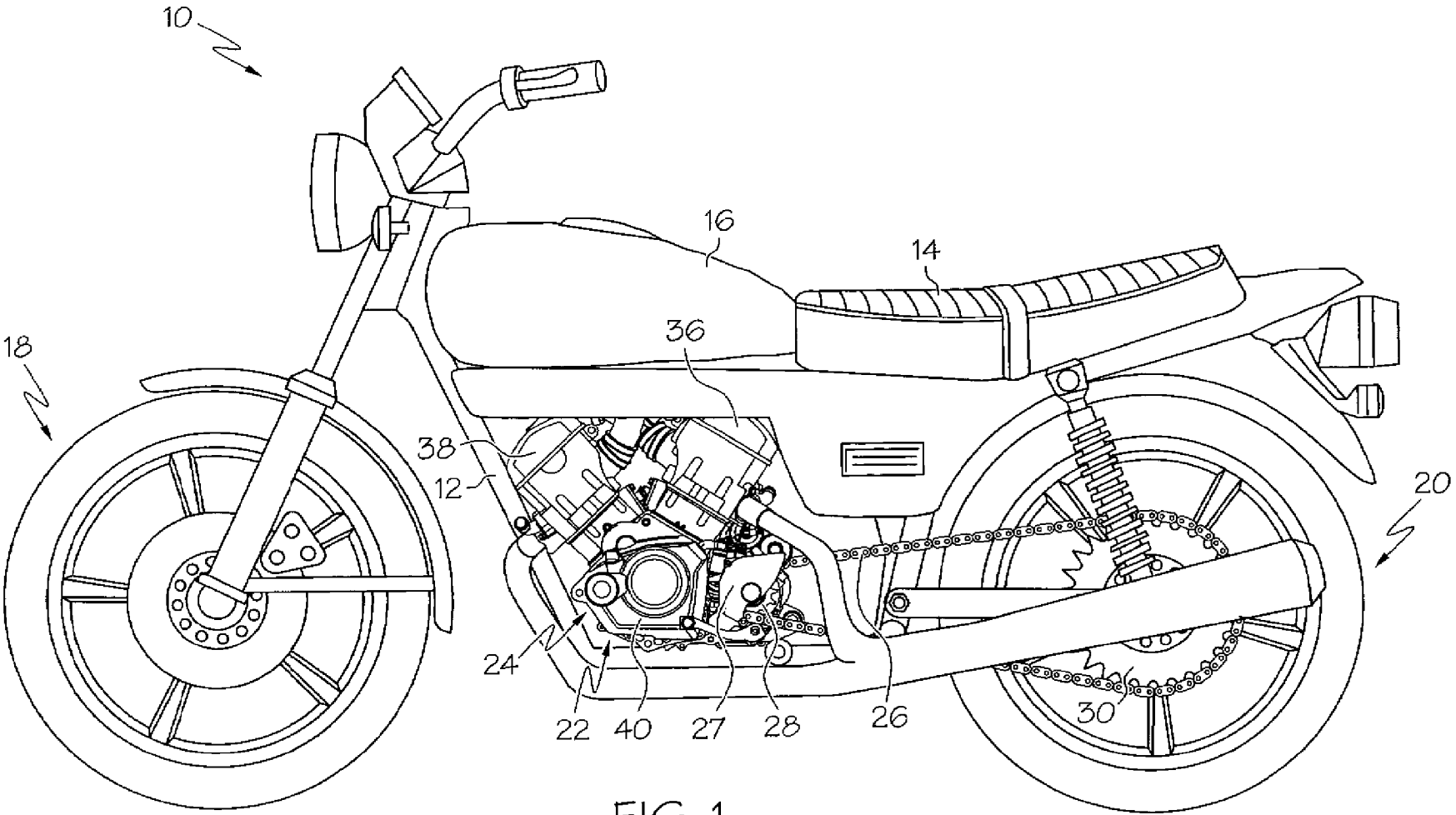
FIG. 1 is a side elevational view depicting a motorcycle having an engine in accordance with one embodiment.
Figure 2:
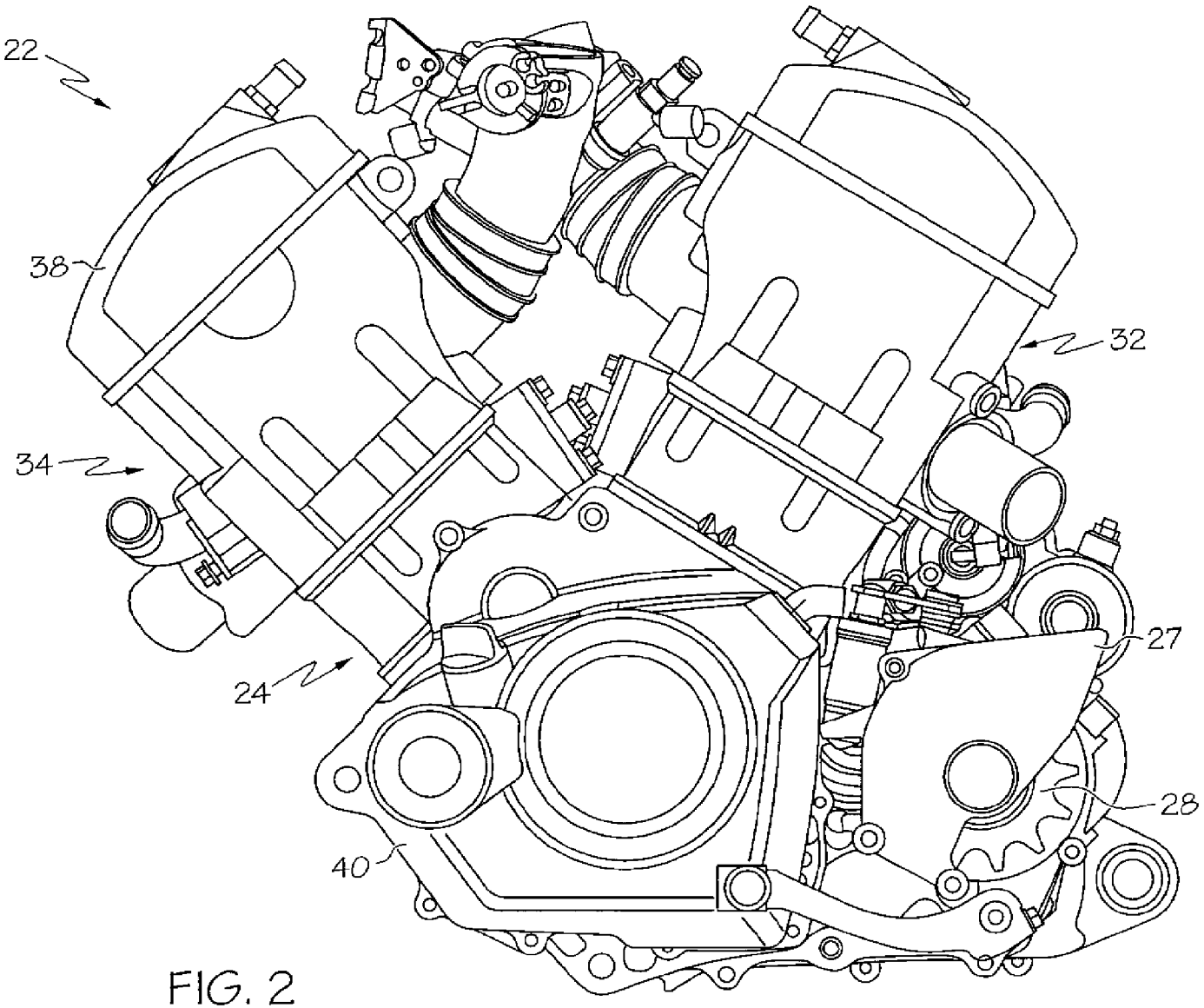
FIG. 2 is a side elevational view depicting the engine removed from the motorcycle of FIG. 1.
Figure 3:
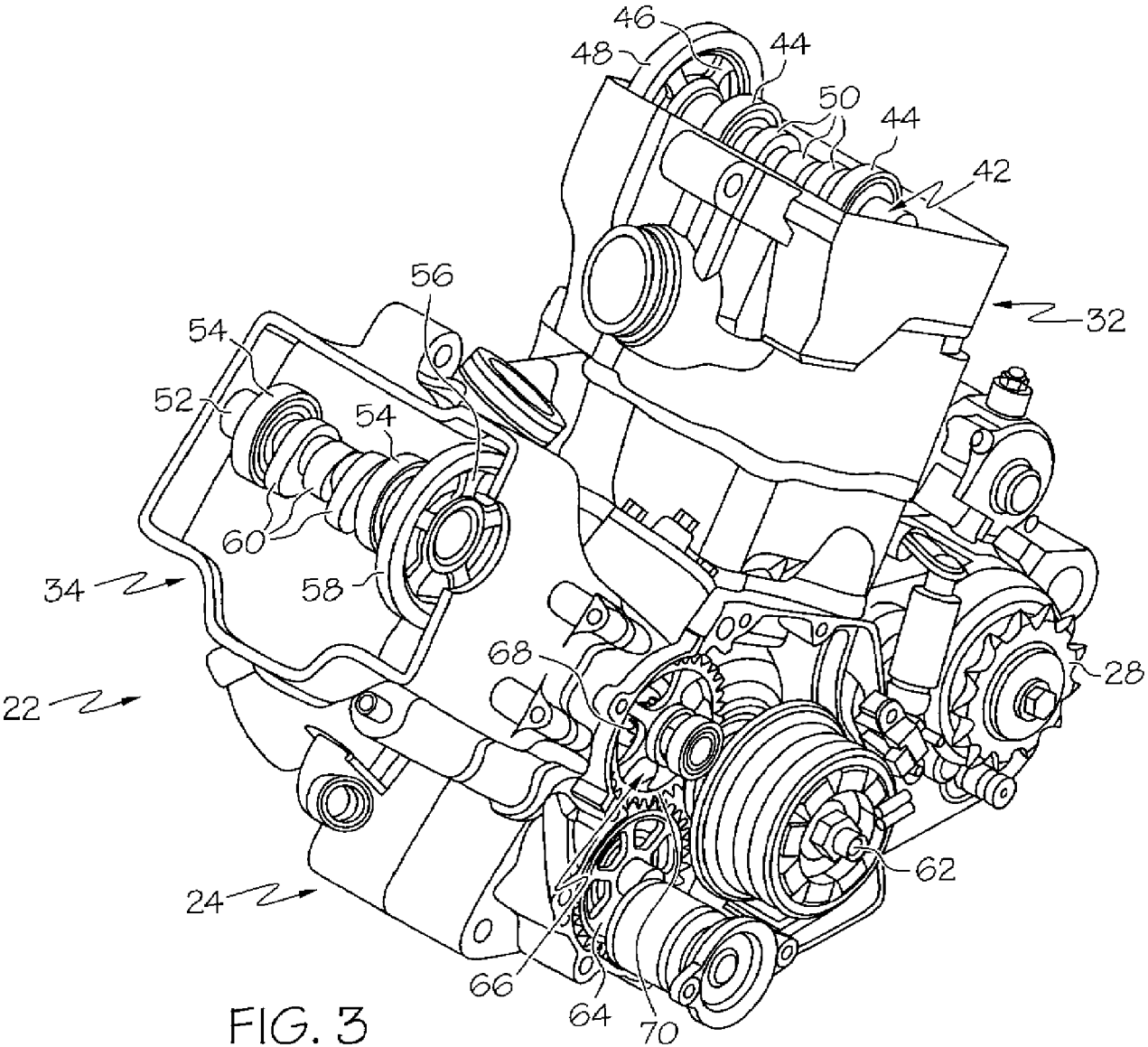
FIG. 3 is a top right perspective view generally depicting the engine of FIG. 2 wherein certain covers and the chain guard have been removed for clarity of illustration.
Figure 4:
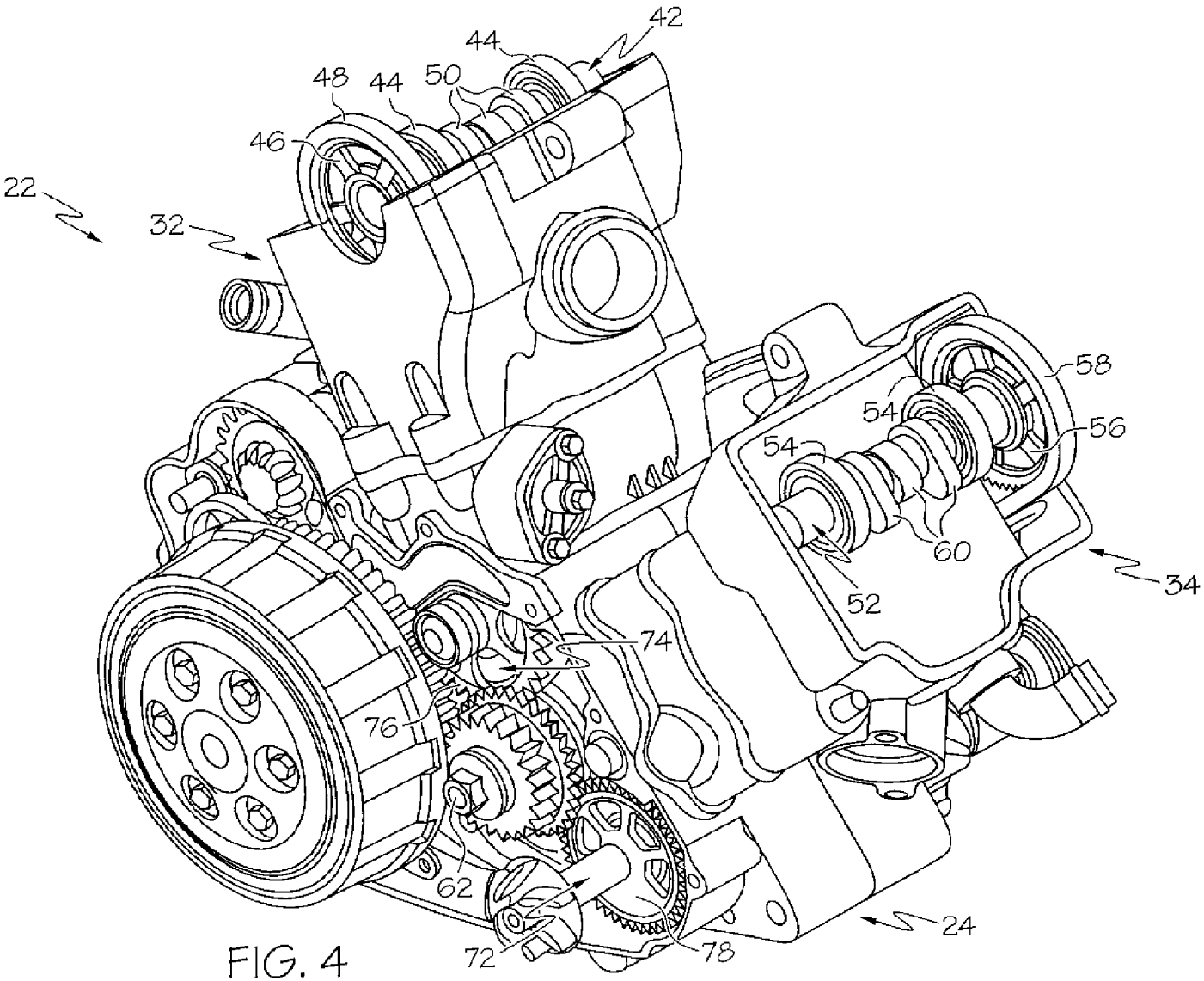
FIG. 4 is a top left perspective view generally depicting the engine of FIGS. 2-3 wherein certain covers have been removed for clarity of illustration.

The present invention and its operation are hereinafter described in detail in connection with the views of FIGS. 1-6, wherein like numbers indicate the same or corresponding elements throughout the views. FIG. 1 depicts a motorcycle 10 having an engine 22 in accordance with one embodiment. As shown in FIG. 1, the engine 22 comprises a V-twin engine, meaning that the engine is a V-type engine having only two pistons. It will be appreciated that an engine can comprise any of a variety of alternative engines such as, for example, V-type engines having four pistons, eight pistons, ten pistons, and twelve pistons. Such an engine can be configured to consume any of a variety of fuels including, for example, gasoline, diesel fuel, kerosene, jet fuel, alcohol, natural gas, propane, and hydrogen. It will furthermore be appreciated that an engine can be provided upon any of a variety of vehicles or machinery other than a motorcycle. For example, an engine can be provided upon an automobile, truck, van, motorcycle, recreational vehicle, watercraft, aircraft, agricultural equipment, construction equipment, toy, all-terrain vehicle, mower, generator, or any of a variety of other vehicles, tools, or machines.

The motorcycle 10 of FIG. 1 is shown to include a seat 14 which is supported by a frame 12 and is configured to support an operator during use of the motorcycle 10. The engine 22 has a housing 24 which is supported by the frame 12. The motorcycle 10 includes a fuel tank 16 which is supported by the frame 12, as well as at least two wheels, such as a front wheel 18 and a rear wheel 20, which are both rotatably supported by the frame 12. At least one of the wheels is configured as a drive wheel for the motorcycle 10 and is operatively coupled with a crankshaft (62 in FIG. 3) of the engine 22 by way of a drive sprocket 28. In the particular embodiment depicted in FIG. 2, a wheel sprocket 30 is attached to the rear wheel 20 such that the rear wheel 20 may serve as a drive wheel for the motorcycle 10. A chain 26 can be provided as shown in FIG. 1 to operatively couple the drive sprocket 28 of the engine 22 with the wheel sprocket 30 of the rear wheel 20. In alternate embodiments, an engine may be operatively coupled with one or more wheels or other driven components without the use of a chain and/or sprockets, and/or through use of one or more belts, chains, shafts, gears, or other drive elements.

Figure 5:
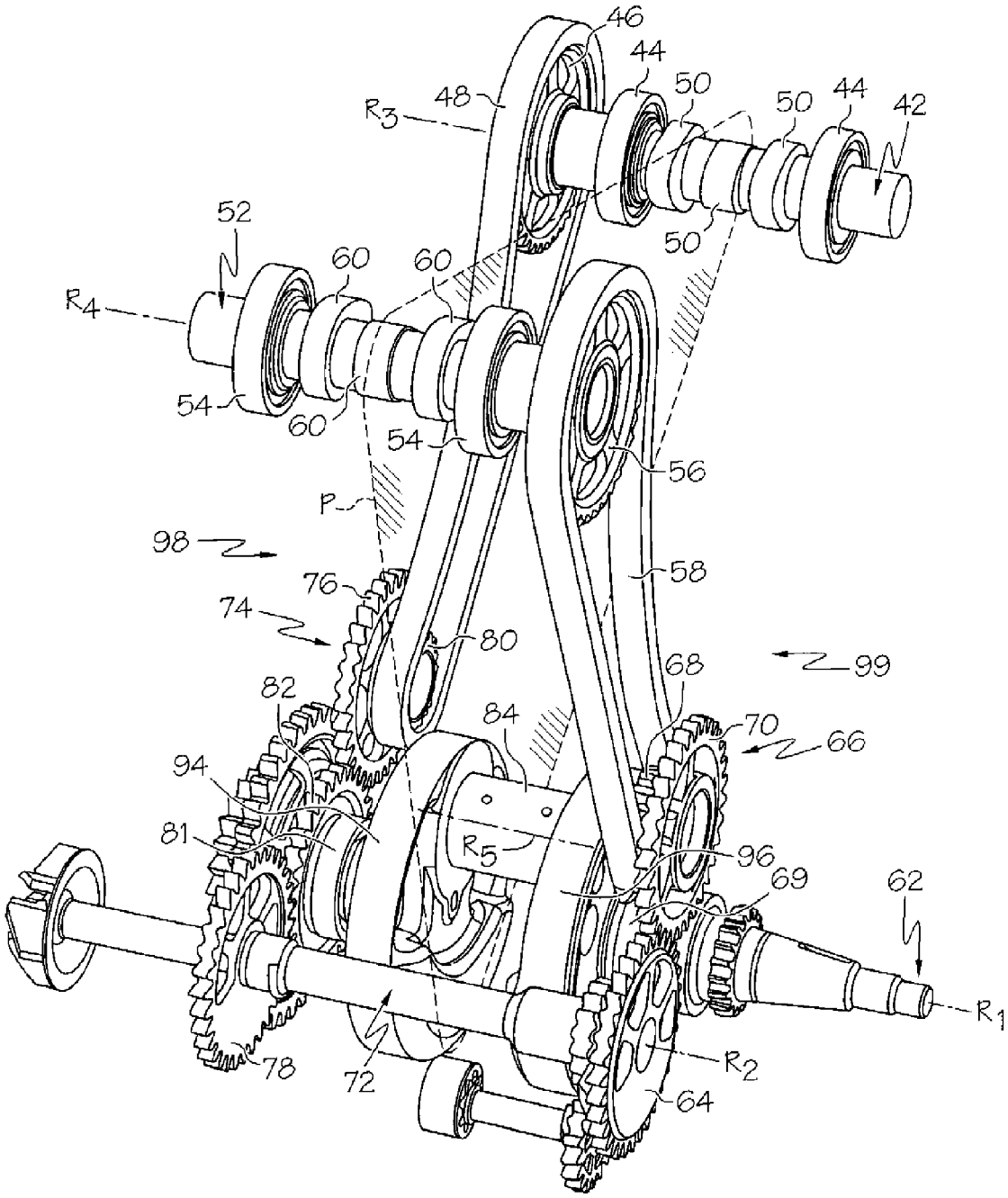
FIG. 5 is a top right perspective view generally depicting certain components of the engine of FIGS. 2-4 apart from the remaining components of the engine.
Figure 6:
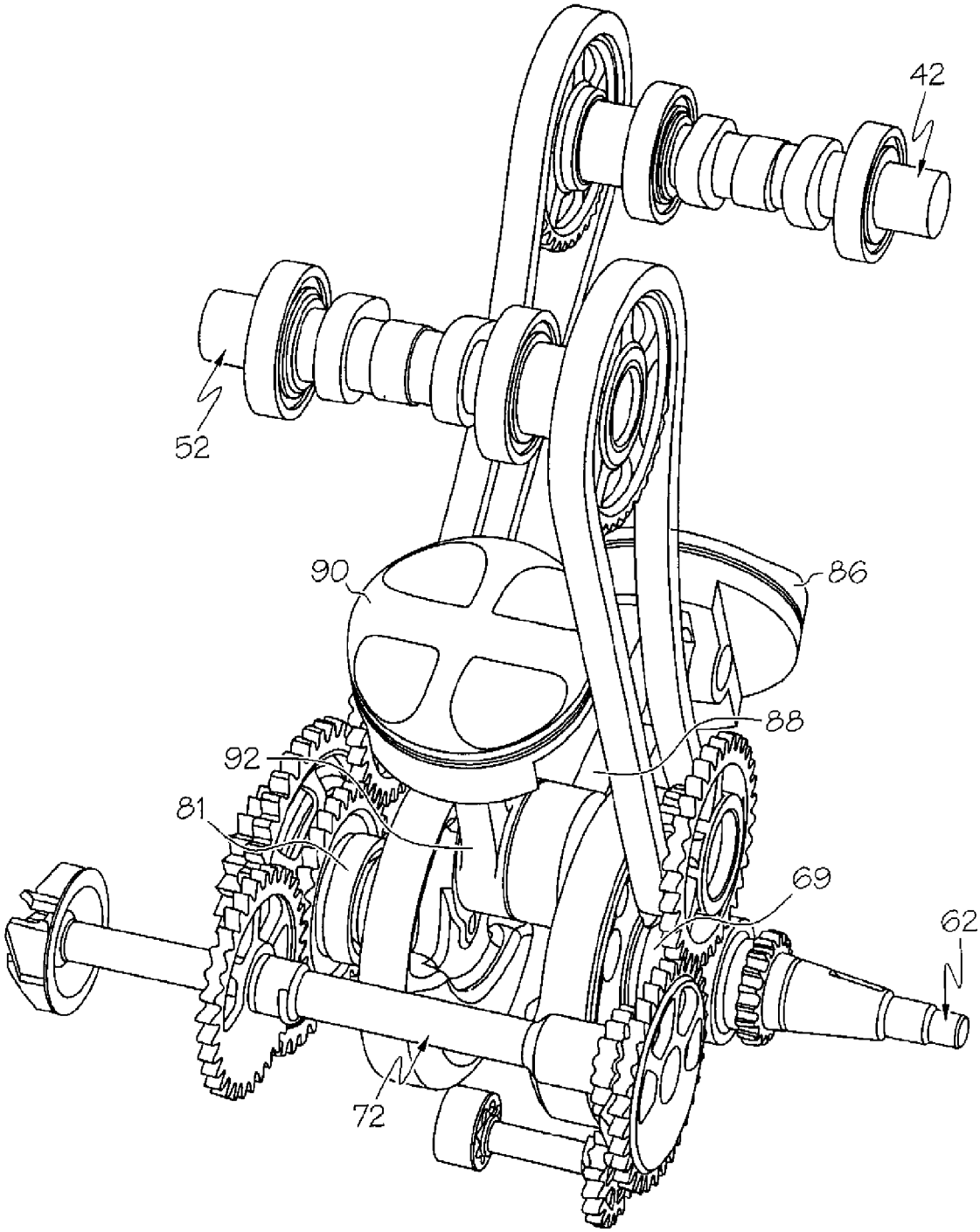
FIG. 6 is a top right perspective view depicting the components of FIG. 5 in association with additional components of the engine.

Referring to FIGS. 2-6, the housing 24 of the engine 22 can include a first piston housing 32 and a second piston housing 34. A first piston (86 in FIG. 6) is slidably disposed within the first piston housing 32, and a second piston (90 in FIG. 6) is slidably disposed within the second piston housing 34. A first connecting rod 88 is shown in FIG. 6 to operatively connect the first piston 86 with a crankpin 84 of the crankshaft 62, and a second connecting rod 92 is shown in FIG. 6 to operatively connect the second piston 90 with the crankpin 84. While the crankpin 84 is shown in FIGS. 5-6 as providing a common rotational axis $R_5$ for attachment of connecting rods (e.g., 88, 92 in FIG. 6) for multiple pistons (e.g., 86, 90 in FIG. 6), it will be appreciated that an alternative crankshaft might include a crankpin which is divided to provide separate rotational axes for attachment of connecting rods for respective pistons.

The crankshaft 62 is rotatably supported by the housing 24 of the engine 22 and is rotatable about a first rotational axis $R_1$ (see FIG. 5). An imaginary plane "P" is perpendicular to the first rotational axis $R_1$ and intersects the crankpin 84, as shown in FIG. 5. The imaginary plane P can also perpendicularly intersect each of a first camshaft 42, a second camshaft 52, and a counterbalance shaft 72, all of which are discussed below. The crankshaft 62 is shown to include counterweights 94 and 96 disposed on opposite sides (e.g., a first side 98 and a second side 99, respectively) of the imaginary plane "P". The counterweights 94, 96 help to balance the weight of the pistons 86, 90 during rotation of the crankshaft 62.

The engine 22 also includes a counterbalance shaft 72 which is rotatably supported by the housing 24 of the engine 22, and which is rotatable about a second rotational axis $R_2$ (see FIG. 5). The first rotational axis $R_1$ is shown in FIG. 5 to be parallel with the second rotational axis $R_2$. The counterbalance shaft 72 rotates in correspondence with the crankshaft 62 to help mitigate any rotational imbalance presented by and/or unresolved by the counterweights 94, 96. In order to provide this mitigation, it will be appreciated that the counterbalance shaft shall itself include a weight imbalance about its rotation. In one embodiment, as shown in FIG. 5, the counterbalance shaft 72 includes driven elements (e.g., gears 64, 78) which are intentionally heavier in some portions than in others to create a desired rotational weight imbalance. However, in an alternate embodiment, one or more weights could be attached to driven element(s) and/or other portion(s) of a counterbalance shaft to attain a desired rotational weight imbalance. The engine 22 can also include a cover 40 for concealing one or more moving components of the engine 22 such as, for example, a clutch and/or transmission.

An engine can include at least two camshafts which are respectively driven on opposite sides of the engine. For example, the engine 22 depicted in FIGS. 3-6 includes a first camshaft 42 and a second camshaft 52. The first camshaft 42 is shown to be rotatably supported by the housing 24 (e.g., through use of bearings 44). The first camshaft 42 is rotatable about a rotational axis $R_3$ (see FIG. 5). The first camshaft 42 is associated with the first piston 86 to appropriately interact with intake and exhaust valves associated with the first piston 86 (e.g., through rotation of one or more lobes 50). The first camshaft 42 also includes a drive element (e.g., a sprocket 46) which can be driven by a flexible drive member (e.g., a chain 48) or otherwise. It will be appreciated that a drive element can comprise, for example, one or more gears, sprockets, chains, belts, pulleys, shafts, wheels, or other devices used to facilitate mechanical transmission of power. A flexible drive member can include, for example, a belt or chain. A first valve cover (e.g., 36 in FIG. 2) can be associated with the first piston housing 32 to enclose and protect the first camshaft 42 and valves associated with the first piston 86.

The second camshaft 52 is shown to be rotatably supported by the housing 24 (e.g., through use of bearings 54). The second camshaft 52 is rotatable about a rotational axis $R_4$ (see FIG. 5). The second camshaft 52 is associated with the second piston 90 to appropriately interact with intake and exhaust valves associated with the second piston 90 (e.g., through rotation of one or more lobes 60). The second camshaft 52 also includes a drive element (e.g., a sprocket 56) which can be driven by a flexible drive member (e.g., a chain 58) or otherwise. A second valve cover (e.g., 38 in FIG. 2) can be associated with the second piston housing 34 to enclose and protect the second camshaft 52 and valves associated with the second piston 90.

The crankshaft 62 is shown to be operatively coupled with each of the counterbalance shaft 72 and the first camshaft 42 on the first side 98 of the imaginary plane P, and the counterbalance shaft 72 is shown to be operatively coupled with the second camshaft 52 on the second side 99 of the imaginary plane P. For example, the crankshaft 62 can include a first drive element (e.g., a gear 82) which is located on the first side 98 of the imaginary plane P. The counterbalance shaft 72 can include a second drive element (e.g., a gear 78) disposed on the first side 98 of the imaginary plane P, in addition to a third drive element (e.g., a gear 64) disposed on the second side 99 of the imaginary plane P. The first and second drive elements (e.g., the gears 82, 78) can be configured to at least partially facilitate the operative coupling of the crankshaft 62 with the counterbalance shaft 72. Accordingly, the counterbalance shaft 72 can be driven by the crankshaft 62 on the first side 98 of the imaginary plane P. In one particular embodiment, as shown in FIGS. 3-6, the gear 82 can contact the gear 78 such that rotation of the crankshaft 62 results in corresponding rotation of the counterbalance shaft 72. However, in alternate embodiments, the gears 78 and 82 might not contact each other, but might rather be operatively coupled with each other through one more intervening gears and/or other operative couplings (e.g., involving one or more additional drive elements such as chains, sprockets, belts, and/or pulleys).

The first camshaft 42 is shown to comprise a fourth drive element (e.g., sprocket 46) disposed on the first side 98 of the imaginary plane P. The first drive element (e.g., gear 82) and the fourth drive element (e.g., sprocket 46) can be configured to at least partially facilitate the operative coupling of the crankshaft 62 with the first camshaft 42. Accordingly, the first camshaft 42 can be driven by the crankshaft 62 on the first side 98 of the imaginary plane P. In the particular embodiment shown in FIGS. 3-6, the gear 82 is shown to be operatively coupled with the first camshaft 42 by way of a drive element 74 which includes a gear 76 and a sprocket 80. The gear 76 is shown to contact the gear 82 such that rotation of the crankshaft 62 results in rotation of the drive element 74. The sprocket 80 is shown to be operatively coupled with the sprocket 46 of the first camshaft 42 by way of a flexible drive member such as a chain 48. In this manner, the chain 48 is configured to at least partially facilitate the operative coupling of the crankshaft 62 with the first camshaft 42. Also, each of the mechanical components (e.g., the chain 48, the drive element 74, the gear 82, and the sprocket 46) facilitating the operative coupling between the crankshaft 62 and the first camshaft 42 are disposed on the first side 98 of the imaginary plane P. It will be appreciated that any of a variety of alternative arrangements of drive elements could be used to facilitate an operative coupling between the crankshaft 62 and the first camshaft 42 on the first side 98 of the imaginary plane P.

The second camshaft 52 comprises a fifth drive element (e.g., sprocket 56). Both of the third drive element (e.g., gear 64) and the fifth drive element (e.g., sprocket 56) can be disposed on the second side 99 of the imaginary plane P and can be configured to at least partially facilitate the operative coupling of the counterbalance shaft 72 with the second camshaft 52 on the second side 99 of the imagine plane P. Accordingly, the second camshaft 52 can be driven by the counterbalance shaft 72 on the second side 99 of the imaginary plane P. In the particular embodiment shown in FIGS. 3-6, a drive element 66 is shown to be provided to include a gear 70 and a sprocket 68. The gear 70 is shown to be operatively coupled with the gear 64 of the counterbalance shaft 72 such that rotation of the counterbalance shaft 72 results in rotation of the drive element 66. The sprocket 68 can be operatively coupled with the sprocket 56 of the second camshaft 52 by a flexible drive member such as a chain 58. In this manner, the chain 58 is configured to at least partially facilitate the operative coupling of the counterbalance shaft 72 with the second camshaft 52. Also, each of the mechanical components (e.g., the chain 58, the drive element 66, the gear 64, and the sprocket 56) facilitating the operative coupling between the counterbalance shaft 72 and the second camshaft 52 are disposed on the second side 99 of the imaginary plane P. It will be appreciated that any of a variety of alternative arrangements of drive elements could be used to facilitate an operative coupling between the counterbalance shaft 72 and the second camshaft 52 on the second side 99 of the imaginary plane P.

In one embodiment each of the crankshaft 62 and the counterbalance shaft 72 have parallel rotational axes (e.g., $R_1$ and $R_2$). In another embodiment, each of the first and second camshafts 42, 52 have parallel rotational axes (e.g., $R_3$ and $R_4$). In still another embodiment, each of the crankshaft 62, the counterbalance shaft 72, the first camshaft 42, and the second camshaft 52 have parallel rotational axes (e.g., $R_1$, $R_2$, $R_3$, and $R_4$).

It will be appreciated that the operative coupling between the crankshaft, the counterbalance shaft, and the camshafts can be achieved in any of a variety of suitable configurations provided that, however, the operative coupling between the crankshaft and one camshaft occurs on one side of an engine's crankpin(s), while the operative coupling between the counterbalance shaft and another camshaft occurs on the other side of the crankpin(s). Such a configuration provides efficiencies in the design of an engine. In particular, this configuration can facilitate the use of interchangeable components. For example, in one embodiment, camshafts, valve covers, valves, pistons, flexible drive members, tensioning mechanisms, and/or other engine components may be interchangeable for use with both piston housings of a V-type engine. By having interchangeable components, fewer different parts must be maintained on hand to construct an engine. It will furthermore be appreciated that such an engine can be manufactured more quickly and with less complexity than a conventional engine.

It will also be appreciated that an engine in accordance with one embodiment can be more narrow and compact than a conventional engine. For example, as best shown in FIGS. 5-6, the drive element 66 includes a sprocket 68 which is aligned with the bearing 69, and thus enables the chain 58 to align with the bearing 69. Likewise, the drive element 74 includes a sprocket 80 which aligns with the bearing 81, and thus enables the chain 48 to align with the bearing 81. In this configuration, with the chains 48 and 58 being aligned with the bearings 81 and 69, respectively, it will be appreciated that the engine 22 can have a narrower profile than conventional engines having flexible drive members which are not aligned with crankshaft bearings and which accordingly result in increased overall engine width.

In addition, it will be appreciated that an engine in accordance with one embodiment can generate significantly less vibration than would a conventional engine of similar size and power capacity. Reduced vibration can allow for smoother engine operation, increased engine speed (and resultant horsepower), improved comfort for the operator of a vehicle, tool or machine incorporating such an engine, and reduced maintenance for such a vehicle, tool or machine. The presence and configuration of the counterbalance shaft within such an engine can contribute to the reduced vibration characteristics of the engine. The reduced vibration can also be due to other aspects of the engine. For example, by rotating the camshafts in opposite directions (as shown in FIG. 5), the inertia of each camshaft can cancel with the inertia of the other camshaft. It is believed, without being bound by theory, that this inertia-cancelling effect can result in reduced engine vibration. However, it will be appreciated that an engine in accordance with an alternative embodiment might employ camshafts which all rotate in the same direction.

The foregoing description of embodiments and examples of the invention has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate the principles of the invention and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A V-type engine comprising:

a housing;

a crankshaft rotatably supported by the housing and having a crankpin;

a first piston operatively connected to the crankpin;

a second piston operatively connected to the crankpin;

a counterbalance shaft rotatably supported by the housing;

a first camshaft rotatably supported by the housing and associated with the first piston;

a second camshaft rotatably supported by the housing and associated with the second piston;

wherein an imaginary plane perpendicular to the rotational axis of the crankshaft intersects each of the crankpin and the counterbalance shaft, and the crankshaft is operatively coupled with each of the counterbalance shaft and the first camshaft on one side of the imaginary plane, and the counterbalance shaft is operatively coupled with the second camshaft on an opposite side of the imaginary plane.

2. The engine of claim 1 wherein the first camshaft and the second camshaft are interchangeable.

3. The engine of claim 1 wherein each of the crankshaft, the counterbalance shaft, the first camshaft and the second camshaft have parallel rotational axes.

4. The engine of claim 1 wherein the crankshaft comprises a first drive element and the counterbalance shaft comprises a second drive element, and both of the first drive element and the second drive element are disposed on the one side of the imaginary plane, and the first drive element and the second drive element are configured to at least partially facilitate the operative coupling of the crankshaft with the counterbalance shaft.

5. The engine of claim 4 wherein each of the first drive element and the second drive element comprise gears in contact with one another.

6. The engine of claim 4 wherein the first camshaft comprises a fourth drive element disposed on the one side of the imaginary plane, and the first drive element and the fourth drive element are configured to at least partially facilitate the operative coupling of the crankshaft with the first camshaft.

7. The engine of claim 6 wherein the counterbalance shaft comprises a third drive element and the second camshaft comprises a fifth drive element, and both of the third drive element and the fifth drive element are disposed on the opposite side of the imaginary plane, and the third drive element and the fifth drive element are configured to at least partially facilitate the operative coupling of the counterbalance shaft with the second camshaft.

8. The engine of claim 7 further comprising a first flexible drive member disposed on the one side of the imaginary plane, wherein the first flexible drive member is configured to at least partially facilitate the operative coupling of the crankshaft with the first camshaft.

9. The engine of claim 8 wherein the first drive element comprises a sprocket, the fourth drive element comprises a sprocket, and the first flexible drive member comprises a chain.

10. The engine of claim 8 further comprising a second flexible drive member disposed on the opposite side of the imaginary plane, wherein the second flexible drive member is configured to at least partially facilitate the operative coupling of the counterbalance shaft with the second camshaft.

11. The engine of claim 10 wherein the third drive element comprises a sprocket, the fifth drive element comprises a sprocket, and the second flexible drive member comprises a chain.

12. The engine of claim 10 wherein the first camshaft and the second camshaft are interchangeable.

13. The engine of claim 1 comprising a V-twin engine.

14. A V-type engine comprising:

a housing;

a crankshaft comprising a crankpin and a first drive element, the crankshaft rotatably supported by the housing;

a counterbalance shaft comprising a second drive element and a third drive element, the counterbalance shaft rotatably supported by the housing such that the second drive element is operatively coupled with the first drive element;

a first camshaft comprising a fourth drive element, the first camshaft rotatably supported by the housing such that the fourth drive element is operatively coupled with the first drive element; and a second camshaft comprising a fifth drive element, the second camshaft rotatably supported by the housing such that the fifth drive element is operatively coupled with the third drive element.

15. The engine of claim 14 wherein the crankshaft is rotatable about a first rotational axis and the counterbalance shaft is rotatable about a second rotational axis, and the first rotational axis is parallel with the second rotational axis.

16. The engine of claim 15 wherein an imaginary plane perpendicular to the first rotational axis intersects the crankpin, and the second drive element and the third drive element are disposed on different sides of the imaginary plane.

17. The engine of claim 16 wherein the first camshaft and the second camshaft are interchangeable.

18. A vehicle having a V-type engine, wherein the V-type engine comprises:

a housing;

a crankshaft rotatably supported by the housing and having a crankpin;

a first piston operatively connected to the crankpin;

a second piston operatively connected to the crankpin;

a counterbalance shaft rotatably supported by the housing;

a first camshaft rotatably supported by the housing and associated with the first piston;

a second camshaft rotatably supported by the housing and associated with the second piston;

wherein an imaginary plane perpendicular to the rotational axis of the crankshaft intersects each of the crankpin and the counterbalance shaft, and the crankshaft is operatively coupled with each of the counterbalance shaft and the first camshaft on one side of the imaginary plane, and the counterbalance shaft is operatively coupled with the second camshaft on an opposite side of the imaginary plane.

19. The vehicle of claim 18 further comprising a frame, a seat supported by the frame and configured to support an operator during use of the vehicle, and a fuel tank supported by the frame, wherein the housing of the engine is supported by the frame.

20. The vehicle of claim 19 further comprising at least two wheels rotationally supported by the frame, wherein at least one of said wheels is configured as a drive wheel and is operatively coupled with the crankshaft of the engine.

21. The vehicle of claim 20 comprising a motorcycle.

* * * * *